US005604506A

United States Patent [19]

Rodal

[11] Patent Number: 5,604,506

[45] Date of Patent: Feb. 18, 1997

[54] DUAL FREQUENCY VERTICAL ANTENNA

[75] Inventor: Eric B. Rodal, Cupertino, Calif.

[73] Assignee: Trimble Navigation Limited, Sunnyvale, Calif.

[21] Appl. No.: 354,617

[22] Filed: Dec. 13, 1994

[51] Int. Cl.[6] ..... H01Q 9/40

[52] U.S. Cl. ..... 343/791; 343/790; 343/792

[58] Field of Search ..... 343/715, 722, 343/749, 790, 791, 792

[56] References Cited

U.S. PATENT DOCUMENTS

| | | | |
|---|---|---|---|
| 2,237,792 | 4/1941 | Roosenstein | 343/846 |
| 2,284,434 | 5/1942 | Lindenblad | 393/790 |
| 2,486,597 | 11/1949 | Greene | 343/792 |
| 2,487,567 | 11/1949 | Lindenblad | 343/791 |
| 3,750,181 | 7/1973 | Kuecken | 393/790 |
| 3,899,787 | 8/1975 | Czerwinski | 343/790 |
| 4,008,479 | 2/1977 | Smith . | |
| 4,030,100 | 6/1977 | Perrotti . | |
| 4,200,874 | 4/1980 | Harada | 343/715 |
| 4,509,056 | 4/1985 | Ploussios | 343/792 X |
| 4,675,687 | 6/1987 | Elliot . | |
| 4,734,703 | 3/1988 | Nakase et al. . | |
| 4,940,989 | 7/1990 | Austin | 343/791 X |
| 5,134,419 | 7/1992 | Egashida | 343/722 |
| 5,148,183 | 9/1992 | Aldama . | |
| 5,252,984 | 10/1993 | Dorrie et al. . | |
| 5,300,936 | 4/1994 | Izadian . | |
| 5,317,327 | 5/1994 | Piole . | |
| 5,440,317 | 8/1995 | Jalloul et al. | 343/702 X |

OTHER PUBLICATIONS

Dorne & Margolin sales literature showing a combination VHF/GPS antenna given a model no. DM CN7–1/A, Nov. 1994.

*Primary Examiner*—Donald T. Hajec
*Assistant Examiner*—Tho Phan
*Attorney, Agent, or Firm*—David R. Gildea

[57] ABSTRACT

A dual frequency vertical antenna for radiating a first and a second airwave signal in response to a first and a second conducted signal, the first airwave signal having a first frequency and the second airwave signal having a second frequency lower than one-half the first frequency. The antenna includes a horizontal base member and a vertical mast, including a coaxially disposed rod, projecting upward from the base member to a masthead. For feeding the conducted signals, a lower mast extension projecting downward from the base member and a tuning sleeve projecting either upward or downward from the base member are tuned to ¼ wavelength at the first frequency and a single coaxial cable is connected between the base member and a feedpoint on the rod. The first airwave signal radiates from a dipole formed of an ¼ wavelength upper rod extension extending upward from the masthead and a concentric ¼ wavelength upper sleeve external to the mast projecting downward from the masthead. The mast is ¼ wavelength at the second frequency for radiating the second airwave signal from a dipole formed of the mast and the base member.

2 Claims, 8 Drawing Sheets

DUAL FREQUENCY VERTICAL ANTENNA

BACKGROUND OF THE INVENTION

1. Field of the Invention

The invention relates generally to antennas and more particularly to a dual frequency, vertical antenna.

2. Description of the Prior Art

Vertical antennas have been used for many years to radiate a radio frequency signals. These antennas commonly radiate (and receive) the signal from a dipole having a horizontal ground plane and a vertical mast extending upward from the ground plane. The signal is vertically polarized and radiate in a direction approximately perpendicular to the mast, decreasing to a null in the direction that the mast extends. The ground plane is typically a horizontal surface area having another function as a wetland, an equipment enclosure, or a vehicle body. Because half of the dipole structure is in the ground plane, the vertical antenna has an advantage of being half the size of other antenna types. A further advantage is that the structure of a vertical antenna can be simple and inexpensive to construct.

Commercial Global Positioning System (GPS) receivers are now used in many navigation, tracking, and timing applications to receive a GPS signal at approximately 1.575 GHz from one or more GPS satellites and to provide a GPS based location. The system, currently including a constellation of 21 to 24 GPS satellites, is controlled and maintained by the United States Government. A GPS antenna receives the GPS satellite signals and provides an electronic GPS signal for the GPS receiver. The GPS receiver measures ranges to four GPS satellites simultaneously where each satellite has a line of sight to the GPS antenna and determines the GPS location. The inherent GPS location accuracy is approximately 20 meters. However, a selective availability (SA) is currently in place that degrades the actual accuracy to the GPS location to the range of 50 meters to 300 meters.

Differential GPS receivers, termed "DGPS" receivers, use differential corrections to improve the accuracy of the GPS based location. These differential corrections are determined by comparing the GPS based location determined by a GPS receiver with a surveyed location. Certain FM stations broadcast these differential corrections in a subcarrier of the FM broadcast signal. The DGPS receiver receives the FM signal and uses the corrections to enhance the location accuracy to a range between 10 meters and a few centimeters.

GPS receivers are used in tracking systems to provide the location of a mobile platform. The platform may be a car, truck, or bus on land, a ship or boat on water, or an airplane or spacecraft above the Earth's surface. A radio on the mobile platform transmits the GPS-based location of the platform to a base station in a radio signal.

A dual frequency antenna has a advantage of using less space and costing less than two separate antennas. Further, a vertical antenna typically uses less space and is inherently simpler and lower cost than other types of antennas. Unfortunately, little work has been done on vertical GPS antennas because of well-known problems that the orbits of the GPS satellites will sometimes place the satellites in the null direction of the antenna and that the vertical polarization of the antenna reduces the received GPS signal strength to approximately one-half the signal strength that is available from a circularly polarized antenna.

Another problem in a design for a dual frequency, vertical antenna is that the extent and structure of the ground plane may change the tuning of the antenna at the higher of the two frequencies radiated by the antenna. In order to minimize the effect of the ground plane it is desirable to radiate the higher of the two frequencies from the upper portion of the mast.

Several patents disclose dual frequency, vertical antennas. Unfortunately, such the antennas that have been disclosed have sacrificed the inherent simplicity and low cost of the vertical antenna.

There is a need for a simple dual frequency, vertical antenna to radiate a higher signal frequency, such as a GPS signal frequency, from an upper portion of a mast and simultaneously to radiate a lower signal frequency.

SUMMARY OF THE INVENTION

It is therefore an object of the present invention to provide a dual frequency, vertical antenna to radiate (and to receive) a first signal frequency and simultaneously to radiate (and to receive) a second signal frequency.

Another object is to provide a dual frequency, vertical antenna having a simple structure including a base member and a mast normal to the base member.

Another object is to provide a dual frequency, vertical antenna wherein the first frequency is radiated from the upper portion of the mast.

Another object is to provide a dual frequency, vertical antenna tuned to radiate a first signal having a selected first frequency within a frequency range between 300 MHz and 4.3 GHz and tuned to radiate a second signal having a selected second frequency within a frequency range between 30 MHz to approximately one half of the first frequency.

Briefly, the preferred embodiment is a structure including a base member, a mast, a means for feeding a first and a second signal to the structure, and a means for tuning the structure to radiate the first and the second signal. The means for feeding includes an embodiment wherein the first and the second signal are fed with the same coaxial cable and an embodiment wherein the first and the second signal are fed with separate coaxial cables.

An advantage of the present invention is that the dual frequency antenna is radiating a first and a second signal from a single, simple structure having a base member and a mast normal to the base member.

Another advantage is that the first signal, having a higher selected frequency than the second signal, is radiated from the upper portion of the structure, thereby minimizing the electrical effects of the base member upon the radiation of the higher frequency signal.

These and other objects and advantages of the present invention will no doubt become obvious to those of ordinary skill in the art after having read the following detailed description of the preferred embodiments which are illustrated in the various figures.

IN THE DRAWINGS

Figure 1:
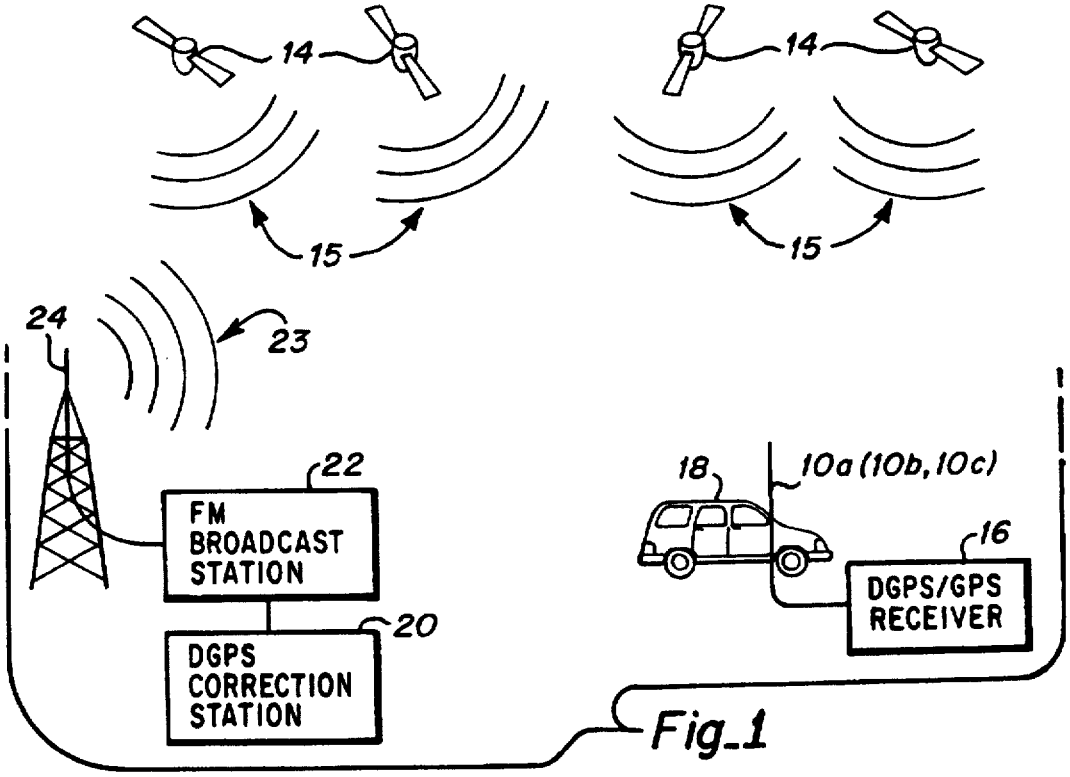
FIG. 1 is a general view of a dual frequency, vertical antenna mounted on a vehicle receiving a GPS signal from a GPS satellite and receiving an FM signal from an FM station.
Figure 3A:
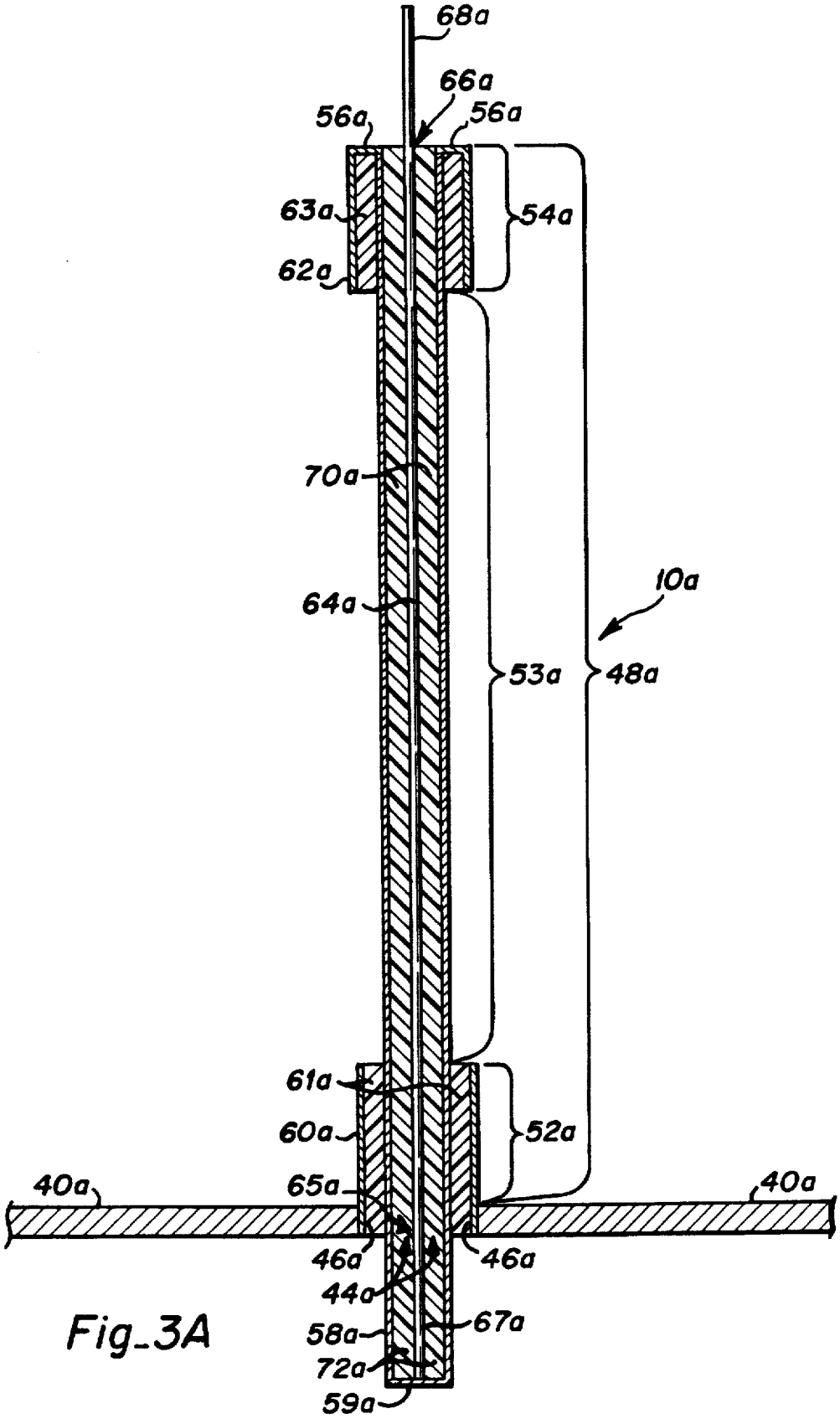
Figure 3B:
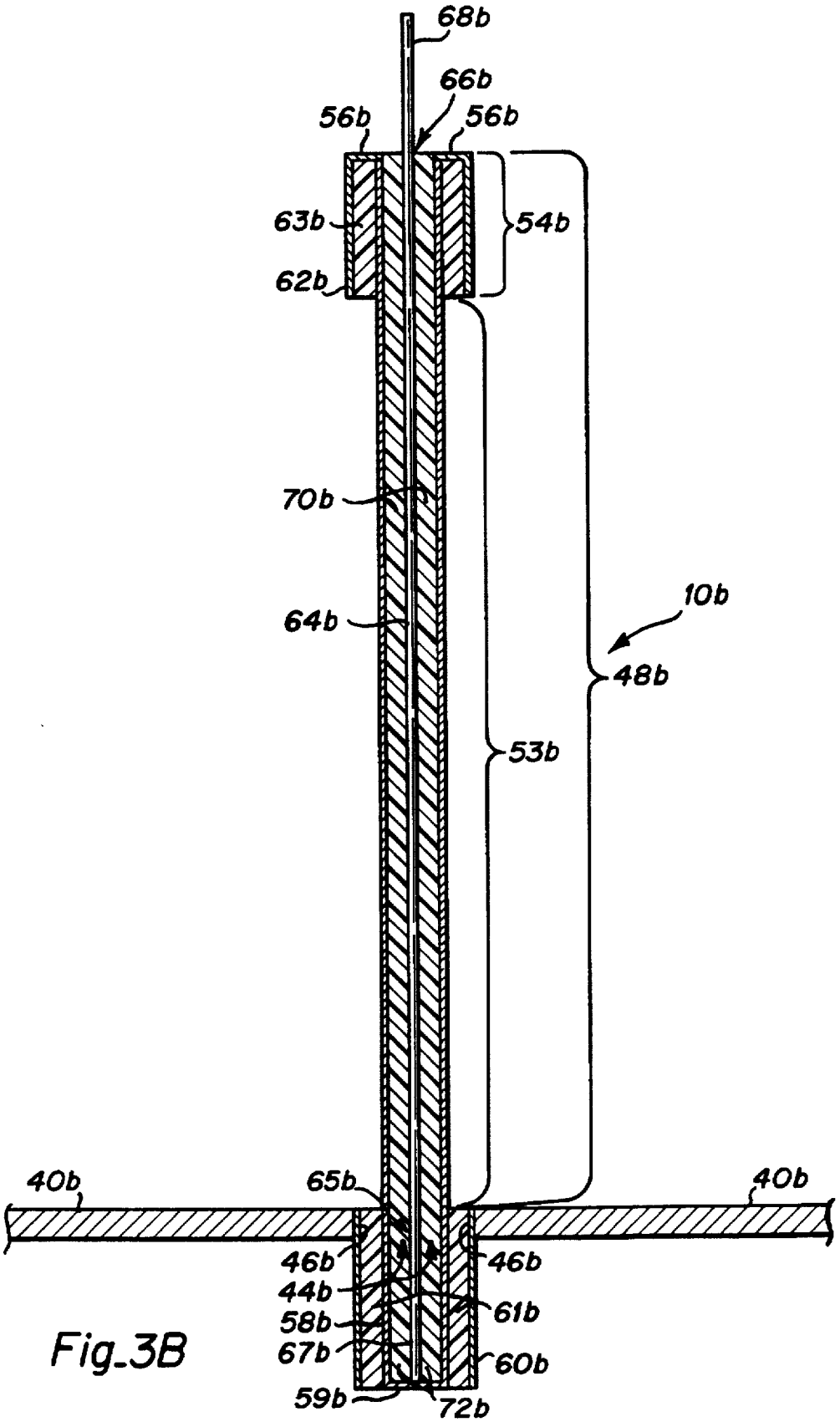
Figure 3C:
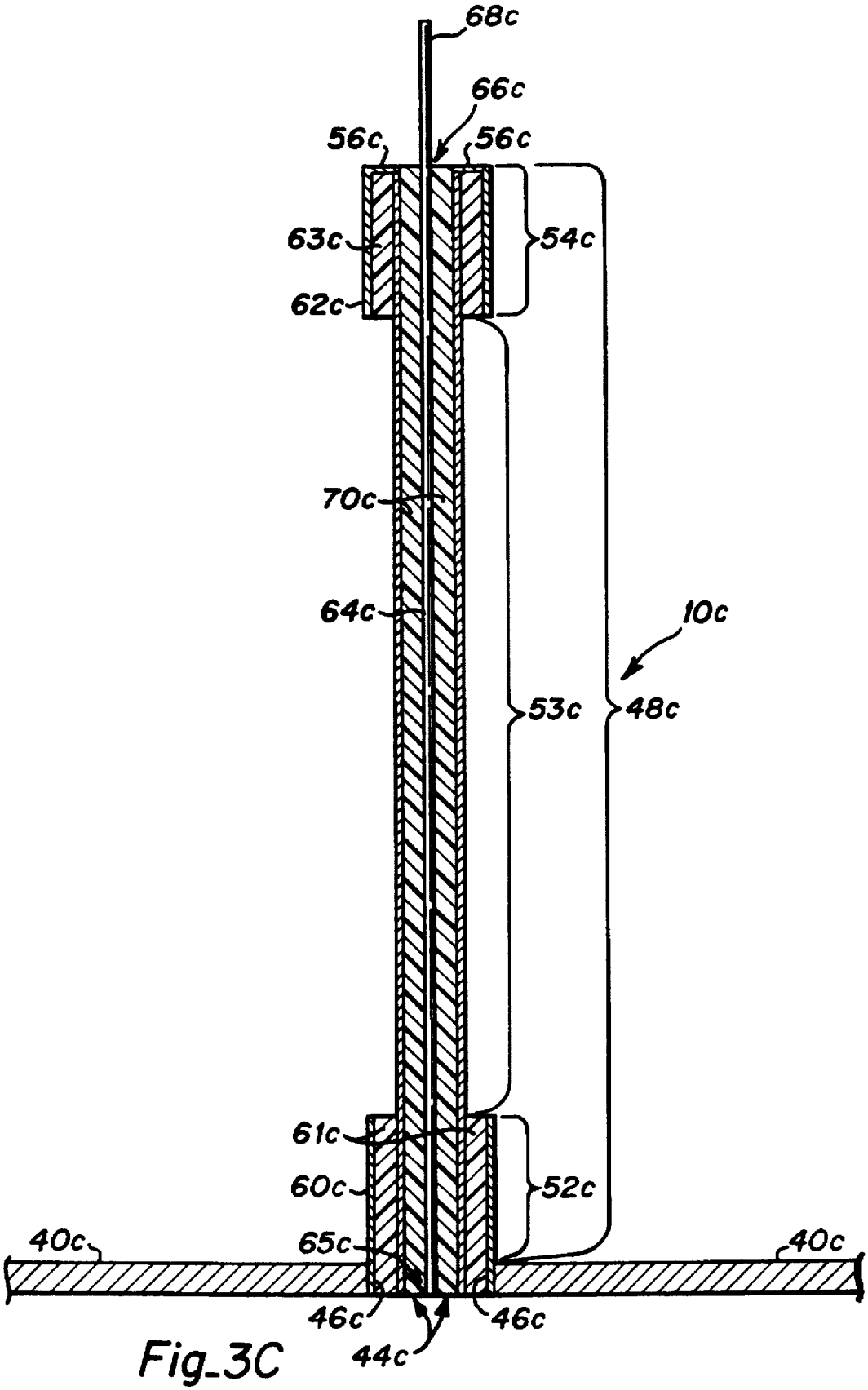
Figure 4A:
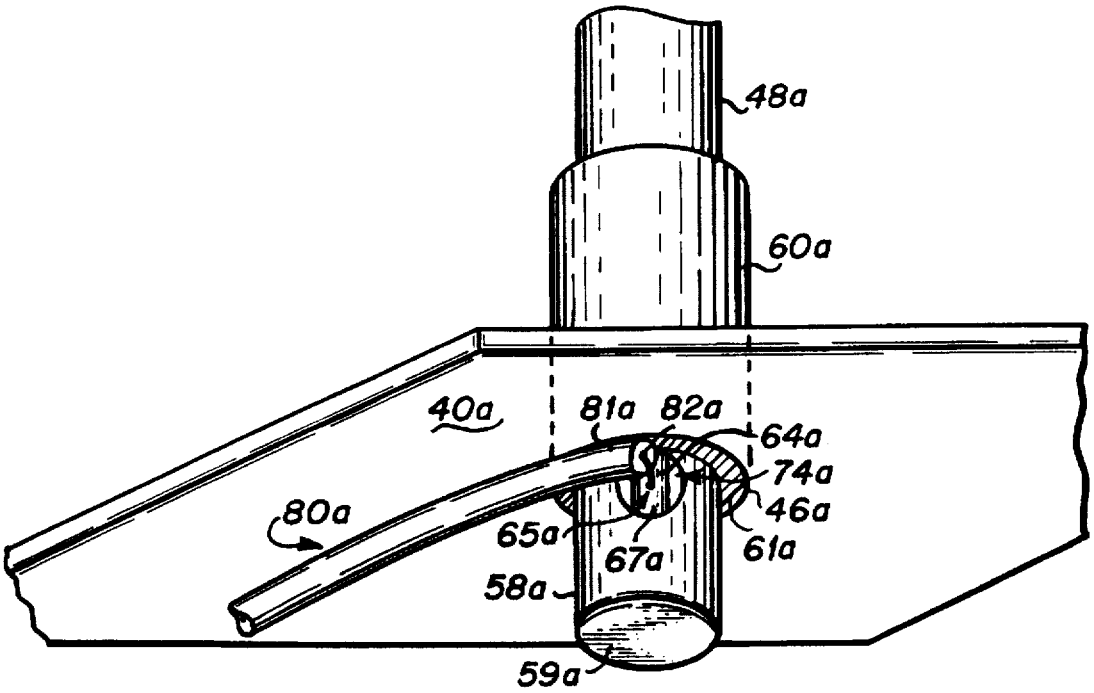

FIG. 3*a* is a sectional view of a first embodiment of the antenna of FIG. 1;

FIG. 3*b* is a sectional view of a second embodiment of the antenna of FIG. 1;

FIG. 3*c* is a sectional view of a third embodiment of the antenna of FIG. 1;

FIG. 4*a* is a bottom perspective view showing a means for feeding signals to the antenna embodiment of FIG. 3*a;*

Figure 4B:
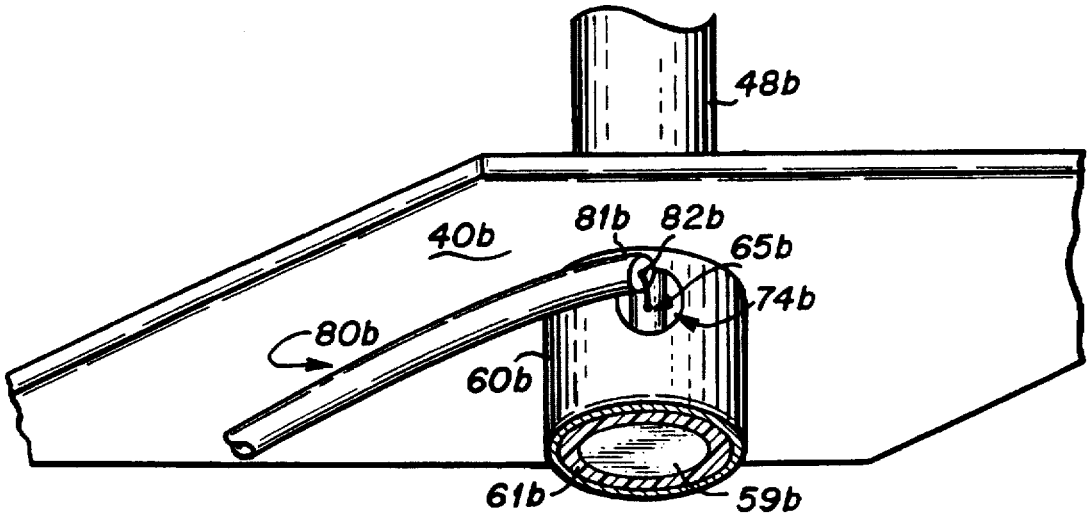

FIG. 4*b* is a bottom perspective view showing a means for feeding signals to the antenna embodiment of FIG. 3*b;*

Figure 4C:
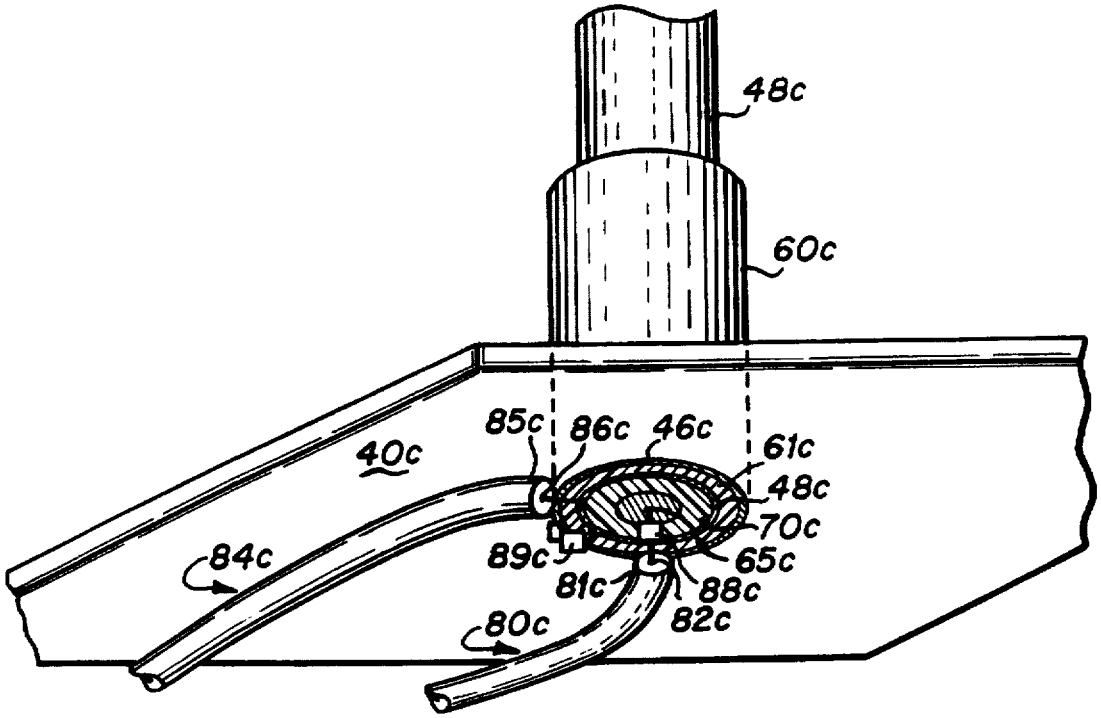

FIG. 4*c* is a bottom perspective view showing a means for feeding signals to the antenna embodiment of FIG. 3*c;*

Figure 5:
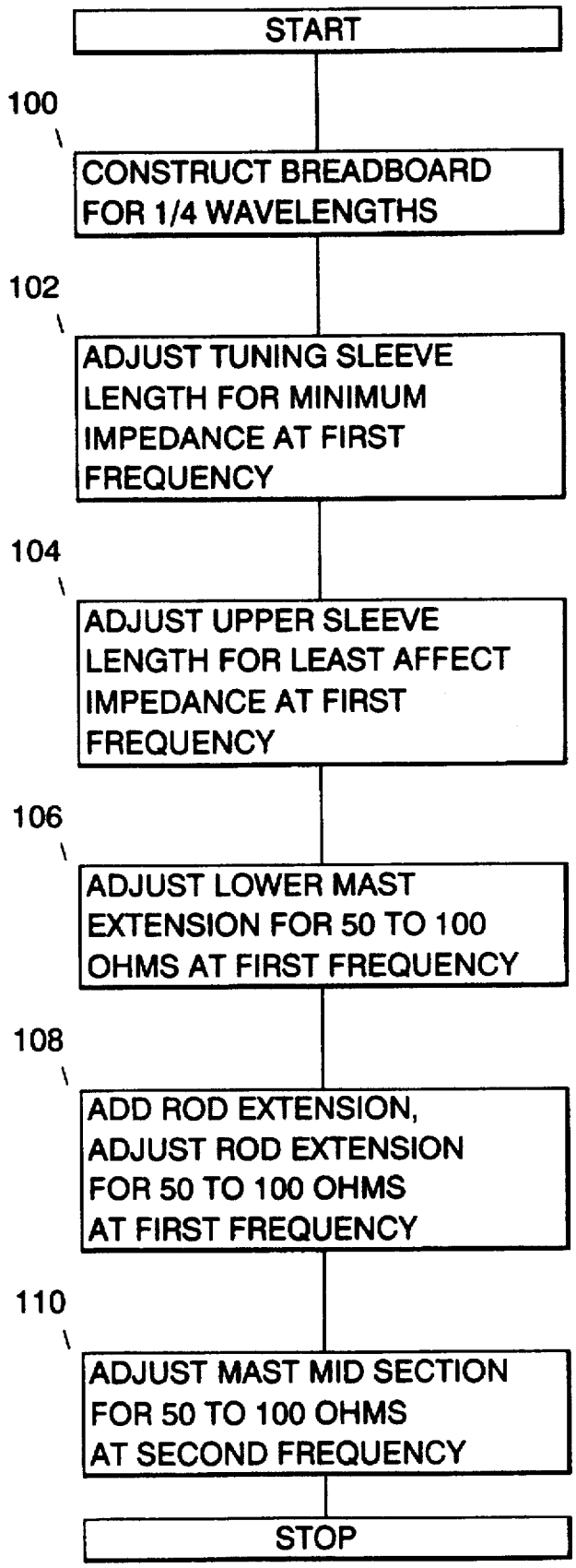
Figure 6:
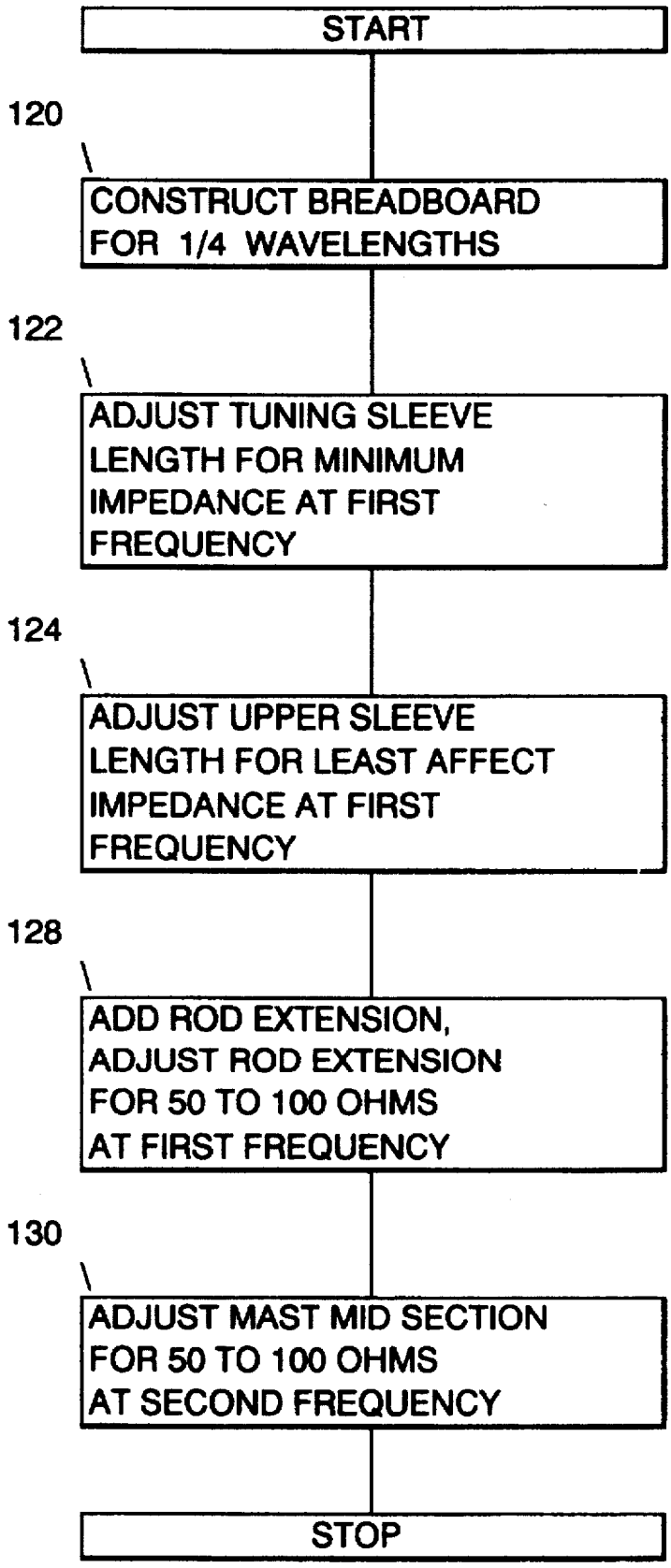

FIG. 5 is a flow chart of a method of tuning the antennas of FIGS. 3*a* and 3*b*; and FIG. 6 is a flow chart of a method of tuning the antenna of FIG. 3*c*.

DETAILED DESCRIPTION OF THE PREFERRED EMBODIMENTS

FIG. 1 illustrates a general view of a dual frequency, vertical antenna referred to by the general designation of 10*a* in a first embodiment, 10*b* in a second embodiment, and 10*c* in a third embodiment. A GPS satellite 14 broadcasts an airwave GPS signal 15 having a carrier at a frequency of approximately 1.575 GHz. The carrier is modulated with a C/A code including information for determining a GPS location. The GPS location has an inherent accuracy of approximately twenty meters. Selective Availability (SA) currently degrades the inherent accuracy to the range of fifty meters to three hundred meters. The antenna 10*a* (10*b*, 10*c*) is tuned by selecting dimensions within the structure to receive the airwave GPS signal 15 as a first signal frequency and to provide an electrical GPS signal at the first frequency. A differential Global Positioning System/GPS (DGPS/GPS) receiver 16 receives the electrical GPS signal and provides the GPS location to human being in a vehicle 18 whereon the antenna 10*a* (10*b*, 10*c*) and the receiver 16 are carried. The vehicle 18 is illustrated as an automobile, however, it can be another mobile platform, such as a truck, bus, train, boat, ship, airplane, or spacecraft.

A DGPS correction station 20 at a surveyed location determines a GPS location and calculates differential corrections based upon the difference between the surveyed and the GPS locations. An FM station 22 broadcasts an airwave FM signal 23 having a carrier frequency in the range of 88 MHz to 116 MHz from an airwave radio antenna 24. The FM signal 23 is modulated with a subcarrier signal that includes information for the differential corrections. The dimensions of the dual frequency antenna 10*a* (10*b*, 10*c*) are further selected to receive the airwave FM signal 23 as a second signal frequency and to provide an electrical FM signal to the DGPS/GPS receiver 16. The DGPS/GPS receiver 16 receives the electrical FM signal and uses the differential corrections in the subcarrier to enhance the accuracy of the GPS location to the range often meters to a few centimeters.

Figure 2:
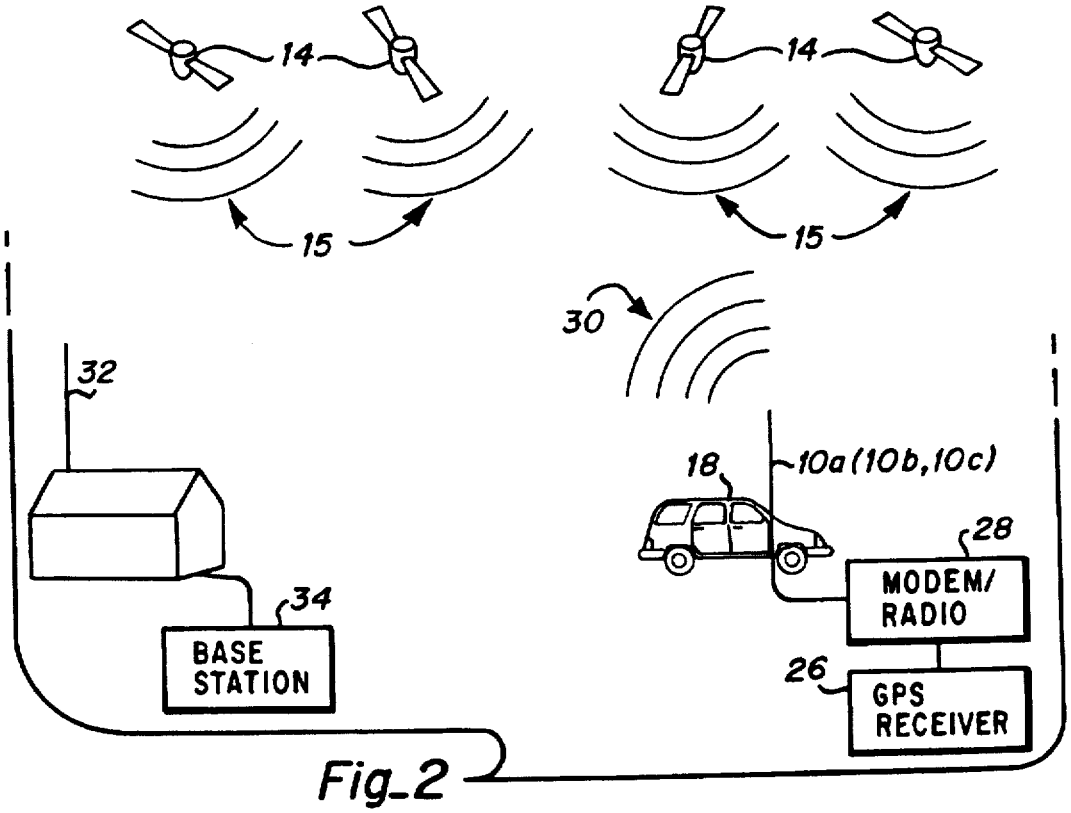
FIG. 2 is a general view of the antenna of FIG. 1 receiving the GPS signal and transmitting a radio signal to a base station.

FIG. 2 illustrates a general view of the dual frequency, vertical antenna referred to by the general designation of 10*a* in a first embodiment, 10*b* in a second embodiment, and 10*c* in a third embodiment. A GPS satellite 14 broadcasts an airwave GPS signal 15 having a carrier at a frequency of approximately 1.575 GHz. The carrier is modulated with a C/A code including information for determining a GPS location with an inherent accuracy of approximately twenty meters or in the range of fifty meters to three hundred meters if selective availability (SA) is turned on. The antenna 10*a* (10*b*, 10*c*) is tuned by selecting dimensions in its structure to receive the airwave GPS signal 15 as a first signal frequency and to provide an electrical GPS signal at the first frequency. A GPS receiver 26 receives the electrical GPS signal and provides the GPS location to a human being in a vehicle 18 whereon the antenna 10*a* (10*b*, 10*c*) and the receiver 26 are carried. The vehicle 18 is illustrated as an automobile, however, it can be another mobile platform, such as a truck, bus, train, boat, ship, airplane, or spacecraft.

A modem/radio 28, including a modem, such as a PSE 200 manufactured by Trimble Navigation or an MRM manufactured by Data Radio and including a radio, such as a Radius or a Spectra family manufactured by Motorola, transmits an airwave radio signal 30 of a frequency in the range of approximately 30 MHz to approximately 1000 MHz. The dimensions of the dual frequency antenna 10*a* (10*b*, 10*c*) are further selected to receive the frequency of the airwave radio signal 30 as a second signal frequency and to provide an electrical radio signal to the GPS receiver 26. The radio signal 30 is modulated to carry the GPS location to a radio antenna 32. The radio antenna 32 provides an electrical signal to the base station 34. The radio signal 30 can be bi-directional to carry control information from the base station 34 to the vehicle 18. The base station 34 may use the GPS location of the vehicle 18 for tracking applications including dispatch, collision avoidance, field inventory control, personal security, and equipment security.

FIG. 3*a* illustrates a sectional view of the dual frequency, vertical antenna 10*a*. An electrically conductive base member 40*a* includes a circular aperture 44*a* defined by an aperture periphery 46*a*. The base member 40*a* may be a part of the surface of the vehicle 18. An electrically conductive, hollow mast 48*a* projects upwardly from the aperture 44*a*, normal to the base member 40*a*. The hollow mast 48*a* includes a mast support section 52*a* projecting from the aperture 44*a*, a mast mid section 53*a* extending from the support section 52*a*, and a mast upper section 54*a* extending from the mid section 53*a* to a mast head 56*a*. A lower mast extension 58*a* extends through the aperture 44*a* downwardly from the support section 52*a* to a mast foot 59*a*. An electrically conductive tuning sleeve 60*a* is electrically connected or integral with the base member 40*a*. The tuning sleeve 60*a* projects upwardly from the aperture periphery 46*a*, coaxially disposed about the mast support section 52*a*. A dielectric material 61 a fills an annular coaxial gap between the tuning sleeve 60*a* and the mast support section 52*a*, supporting the mast 48*a* from the base member 40*a*.

An electrically conductive upper sleeve 62*a*, coaxially disposed about the mast upper section 54*a*, is electrically connected to the mast 48*a* at the mast head 56*a*. A dielectric material 63*a* fills an annular coaxial gap between the upper sleeve 62*a* and the upper section 54*a*. An electrically conductive rod 64*a*, coaxially disposed within the mast 48*a*, extends from a feed point 65*a* adjacent to the aperture 44*a* to an exit point 66*a* adjacent to the mast head 56*a*. A lower rod extension 67*a*, coaxially disposed within the lower mast extension 58*a*, extends downwardly from the feed point 65*a* and is electrically connected to the lower mast extension 58*a* at the mast foot 59*a*. An upper rod extension 68*a* extends upwardly from the exit point 66*a*. A dielectric material 70*a* fills an annular coaxial gap between the mast 48*a* and the rod 64*a*. A dielectric material 72*a* fills an annular coaxial gap between the lower rod extension 67*a* and the lower mast extension 58*a*. The dielectric materials 63*a*, 70*a*, 61*a*, and 72*a* may be mostly or entirely air.

FIG. 3*b* illustrates a sectional view of the dual frequency, vertical antenna 10*b*. An electrically conductive base member 40b includes a circular aperture 44b defined by an aperture periphery 46b. The base member 40b may be a part of the surface of the vehicle 18. An electrically conductive, hollow mast 48b projects upwardly from the aperture 44b, normal to the base member 40b. The hollow mast 48b includes a mast mid section 53b projecting from the aperture 44b and a mast upper section 54b extending from the mid section 53b to a mast head 56b. A lower mast extension 58b extends through the aperture 44b downwardly from the mid section 53b to a mast foot 59b. An electrically conductive tuning sleeve 60b is electrically connected or integral with the base member 40b. The tuning sleeve 60b projects downwardly from the aperture periphery 46b, coaxially disposed about the lower mast extension 58b. A dielectric material 61b fills an annular coaxial gap between the tuning sleeve 60b and the lower mast extension 58b, supporting the mast 48b from the base member 40b.

An electrically conductive upper sleeve 62b, coaxially disposed about the mast upper section 54b, is electrically connected to the mast 48b at the mast head 56b. A dielectric material 63b fills an annular coaxial gap between the upper sleeve 62b and the upper section 54b. An electrically conductive rod 64b, coaxially disposed within the mast 48b, extends from a feed point 65b adjacent to the aperture 44b to an exit point 66b adjacent to the mast head 56b. A lower rod extension 67b, coaxially disposed within the lower mast extension 59b, extends downwardly from the feed point 65b and is electrically connected to the lower mast extension 58b at the mast foot 59b. An upper rod extension 68b extends upwardly from the exit point 66b. A dielectric material 70b fills an annular coaxial gap between the mast 48b and the rod 64b. A dielectric material 72b fills an annular coaxial gap between the lower rod extension 67b and the lower mast extension 58b. The dielectric materials 63b, 70b, 61b, and 72b may be mostly or entirely air.

FIG. 3c illustrates a sectional view of the dual frequency, vertical antenna 10c. An electrically conductive base member 40c includes a circular aperture 44c defined by an aperture periphery 46c. The base member 40c may be a part of the surface of the vehicle 18. An electrically conductive, hollow mast 48c projects upwardly from the aperture 44c, normal to the base member 40c. The hollow mast 48c includes a mast support section 52c projecting from the aperture 44c, a mast mid section 53c extending from the support section 52c, and a mast upper section 54c extending from the mid section 53c to a mast head 56c. An electrically conductive tuning sleeve 60c is electrically connected or integral with the base member 40c. The tuning sleeve 60c projects upwardly from the aperture periphery 46c, coaxially disposed about the mast support section 52c. A dielectric material 61c fills an annular gap between the tuning sleeve 60c and the mast support section 52c, supporting and insulating the mast 48c from the base member 40c.

An electrically conductive upper sleeve 62c, coaxially disposed about the mast upper section 54c, is electrically connected to the mast 48c at the mast head 56c. A dielectric material 63c fills an annular coaxial gap between the upper sleeve 62c and the upper section 54c. An electrically conductive rod 64c, coaxially disposed within the mast 48c, extends from a feed point 65c at the bottom of the rod 64c adjacent to the aperture 44c to an exit point 66c adjacent to the mast head 56c. An upper rod extension 68c extends upwardly from the exit point 66c. A dielectric material 70c fills an annular coaxial gap between the mast 48c and the rod 64c. The dielectric materials 63c, 70c, and 61c may be mostly or entirely air.

FIG. 4a is a perspective bottom view illustrating a means for feeding an electrical signal to the antenna 10a. To "feed" is used herein to mean either to "receive" or to "issue." An electrical cable 80a having an outer conductor 81a and having an inner conductor 82a carries the first signal and the second signal. The first signal frequency is higher than the second signal frequency. The outer conductor 81a electrically connects to the base member 40a at the aperture periphery 46a, preferably at multiple points. The inner conductor 82a electrically connects to the feed point 65a. A feed hole 74a adjacent to the feed point 65a is made through the lower mast extension 58a and the dielectric material 72a to allow the inner conductor 82a to connect to the feed point 65a. It is important that the lengths of material used to connect the outer conductor 81 a to the aperture periphery 46a and to connect the inner conductor 82a to the feed point 65a be less than approximately 1/40 of the electrical wavelength of the higher frequency. Desirably, the lengths are kept as short as possible.

FIG. 4b is a perspective bottom view illustrating a means for feeding an electrical signal to the antenna 10b. To "feed" is used herein to mean either to "receive" or to "issue." An electrical cable 80b having an outer conductor 81b and having an inner conductor 82b carries the first signal and the second signal. The first signal frequency is higher than the second signal frequency. The outer conductor 81b electrically connects to the base member 40b, or to the tuning sleeve 60b, adjacent to the aperture periphery 46b, preferably at multiple points. The inner conductor 82b electrically connects to the feed point 65b. A feed hole 74b adjacent to the feed point 65b are made through the tuning sleeve 60b, the dielectric material 61b, the lower mast extension 58b (shown in FIG. 3b), and the dielectric material 72b (shown in FIG. 3b) to connect to the feed point 65b. It is important that the lengths of material used to connect the outer conductor 81b to the aperture periphery 46b and to connect the inner conductor 82b to the feed point 65b be less than approximately 1/40 of the wavelength of the higher frequency. Desirably, the lengths are kept as short as possible.

FIG. 4c is a perspective bottom view illustrating a means for feeding an electrical signal to the antenna 10c. To "feed" is used herein to mean either to "receive" or to "issue." A first signal has a higher frequency than a second signal. An electrical cable 80c having an outer conductor 81c and having an inner conductor 82c carries the first signal and an electrical cable 84c having an outer conductor 85c and an inner conductor 86c carries the second signal. The outer conductor 81c electrically connects to the base member 40c at the aperture periphery 46c, preferably at multiple points. The inner conductor 82c electrically connects through a first filter 88c to the feed point 65c. The outer conductor 85c electrically connects to the base member at the aperture periphery 46c and the inner conductor 86c electrically connects to the mast 48c adjacent to the aperture periphery 46c. A second filter 89c is electrically connected across the aperture periphery 46c and the mast 48c adjacent to the aperture periphery 46c. For example, where the first frequency is 1.575 GHz and the second frequency is 100 MHz, the filters 88c and 89c are each 5 picofarads (pf).

Although the first and second filters 88c and 89c are illustrated as single components, one or both filters 88c and 89c may have additional components in order to better separate the first signal and the second signal. The first filter 88c may have a pair of input terminals and a pair of output terminals. One input terminal is electrically connected to the outer conductor 81c and the other input terminal to the inner conductor 82c. One output terminal is electrically connected to the feed point 65c and the other output terminal is connected to the aperture periphery 46c. Similarly, the second filter may have a pair of input terminals and a pair of output terminals. One input terminal is electrically connected to the outer conductor 85c and the other input terminal to the inner conductor 86c. One output terminal is electrically connected to the mast 48c adjacent to the aperture periphery 46c and the other output terminal is connected to the aperture periphery 46c.

It is important that the lengths of material used in the electrical connections described above be less than approximately 1/40 of the electrical wavelength of the higher frequency. Desirably, the lengths are kept as short as possible.

FIG. 5 describes a method for tuning the antenna 10a (and the antenna 10b) to radiate the first airwave signal at a frequency in the range of 300 MHz to 4.3 GHz and to radiate the second airwave signal at a frequency in the range of 30 MHz to approximately one half the frequency of the first signal. To "radiate" is used herein to mean either to "transmit" or to "receive." The first signal frequency is radiated from the upper end of the structure from a dipole where the upper rod extension 68a (68b) and the upper sleeve 62a (62b) are the two dipole arms. The second signal frequency is radiated from a dipole where the base member 40a (40b) is one arm and a combination of the mast 48a (48b) and the upper rod extension 68a (68b) operating together is the second arm. In step 100, a breadboard of the antenna 10a (10b) is constructed. The elements of the lower mast extension 58a (58b), the tuning sleeve 60a (60b), the upper sleeve 62a (62b), and the lower rod extension 67a (67b) are breadboarded with geometric lengths of approximately 1/4 wavelength at the first frequency. A seventy five ohm load is connected between the upper sleeve 62a (62b) and the rod 64a (64b) at the mast head 56a (56b). The upper rod extension 68a (68b) will replace the seventy five ohm load later.. A geometric length of 1/4 wavelength at a desired frequency, f, is calculated according to equation 1.

$$\text{geometric length}=c/(4*f) \quad (1)$$

where c is speed of light and f, is frequency

Table 1 illustrates exemplary geometric lengths for 1/4 wavelength at frequencies of 300 MHz, 1.575 GHz, and 4.3 GHz.

TABLE 1

| frequency | geometric length |
|---|---|
| 300 MHz | 25 cm |
| 1.575 GHz | 4.77 cm |
| 4.3 GHz | 1.75 cm |

Fringing effects and the use of dielectric materials having relative dielectric constants greater than one will cause the electrical lengths of the elements to be different, typically shorter, than the geometric lengths. The following steps in FIG. 5 describe the method to adjust the electrical lengths of the elements to 1/4 wavelength at the desired frequencies. In step 102 the electrical length of the tuning sleeve 58a (58b) is adjusted so that an impedance measured at the first frequency between the aperture periphery 46a (46b) and a point on the outside of the mast 48a (48b) adjacent to the aperture periphery 46a (46b) is minimized. In step 104, a frequency is noted where an impedance measured between the aperture periphery 46a (46b) and the feed point 65a (65b) is least affected by touching a small conductor up and down the mast mid section 53a (53b). The electrical length of the upper sleeve 62a (62b) is adjusted until the noted frequency is the desired first frequency. In step 106, the electrical length of the lower mast extension 58a (58b) and the lower rod extension 67a (67b) are adjusted together so that an impedance measured at the first frequency between the feed point 65a (65b) and the aperture periphery 46a (46b) is real and in the range of fifty to one hundred ohms. In step 108, the seventy five ohm load is replaced by the upper rod extension 68a (68b). The electrical length of the upper rod extension 68a (68b) is adjusted so that the impedance measured at is the first frequency between the feed point 65a (65b) and the aperture periphery 46a (46b) is real and in the range of fifty to one hundred ohms.

In step 110, the electrical length of the mast mid section 53a (53b) is adjusted so that the impedance measured at the desired second frequency between the feed point 65a (65b) and the aperture periphery 46a (46b) is real and in the range of fifty to one hundred ohms. Alternatively, a shorter electrical length for the mast mid section 53a (53b) may be tuned to a real impedance in the range of fifty to one hundred ohms with conventional electrical circuit elements in a circuit in the DGPS/GPS receiver 16 or GPS receiver 26.

When the proper electrical lengths have been determined, the elements the lower mast extension 58a (58b), the tuning sleeve 60a (60b), the upper sleeve 62a (62b), the lower rod extension 67a (67b), the upper rod extension 68a (68b) are included in the structure of a means for tuning the antenna 10a (10b) to radiate the higher first frequency. When the proper electrical lengths have been determined, the elements of the base member 40a (40b), the mast 48a (48b), and the upper rod extension 68a (68b) are included in the structure of a means for tuning the antenna 10a (10b) to radiate the lower second frequency. The antenna 10a (10b) may be tuned to receive a first signal having a frequency in a range of 300 MHz to 4.3 GHz and a second signal having a frequency in a range of 30 MHz to one half of the first frequency. When tuned as described the antenna 10a (10b) effectively transmits or receives frequencies within 20% of the frequencies to which the antenna is tuned.

FIG. 6 describes a method for tuning the antenna 10c to radiate the first airwave signal at a frequency in the range of 300 MHz to 4.3 GHz and to radiate the second airwave signal at a frequency in the range of approximately 30 MHz to approximately one half the frequency of the first signal. To "radiate" is used herein to mean either to "transmit" or to "receive." The first signal frequency is radiated from the upper end of the structure from a dipole where the upper rod extension 68c and the upper sleeve 62c are the two arms. The second signal frequency is radiated from a dipole where the base member 40c is one arm and a combination of the mast 48c and the upper rod extension 68c operating together is the second arm. In step 120, a breadboard of the antenna 10c is constructed. The elements of the tuning sleeve 60c and the upper sleeve 62c are breadboarded with geometric lengths of one quarter wavelength at the first frequency. A seventy five ohm load is connected between the upper sleeve 62c and the rod 64c at the mast head 56c. The upper rod extension 68c will replace the seventy five ohm load later. A geometric length of 1/4 wavelength is calculated according to equation 1. Fringing effects and the use of dielectric materials having relative dielectric constants greater than one will cause the electrical lengths of the elements to be different, typically shorter, than the geometric lengths.

The following steps in FIG. 6 describe the method to adjust the electrical lengths of the elements to have electrical lengths of 1/4 wavelength at the desired frequencies. In step 122 the electrical length of the tuning sleeve 58c is adjusted so that an impedance measured at the first frequency between the aperture periphery 46c and a point on the outside of the mast 48c adjacent to the aperture periphery

46*c* is minimized. In step 124, a frequency is noted where an impedance measured between the aperture periphery 46*c* and the feed point 65*c* is least effected by touching a small conductor up and down the mast mid section 53*c*. The electrical length of the upper sleeve 62*c* is adjusted until the noted frequency is the desired first frequency. In step 128, the seventy five ohm load is replaced by the upper rod extension 68*c*. The electrical length of the upper rod extension 68*c* is adjusted so that the impedance measured at the first frequency between the feed point 65*c* and the aperture periphery 46*c* is real and in the range of fifty to one hundred ohms.

In step 130, the electrical length of the mast mid section 53*c* is adjusted so that the impedance measured at the desired second frequency between the feed point 65*c* and the aperture periphery 46*c* is real and in the range of fifty to one hundred ohms. Alternatively, a shorter electrical length for the mast mid section 53*c* may be tuned to a real impedance in the range of fifty to one hundred ohms with conventional electrical circuit elements in a circuit in the DGPS/GPS receiver 16 or GPS receiver 26.

When the proper electrical lengths have been determined, the elements of the tuning sleeve 60*c*, the upper sleeve 62*c*, and the upper rod extension 68*c* are included in the structure of a means for tuning the antenna 10*c* to radiate the higher first frequency signal. When the proper electrical lengths have been determined, the elements of the base member 40*c*, the mast 48*c*, and the rod extension 68*c* are included in a means for tuning the antenna 10*c* to radiate a lower second frequency signal. The antenna 10*c* may be tuned to receive a first signal having a frequency in a range of 300 MHz to 4.3 GHz and a second signal having a frequency in a range of 30 MHz to one half of the first frequency. When tuned as described the antenna 10*c* effectively transmits and receives frequencies within 20% of the frequency to which the antenna is tuned.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A dual frequency vertical antenna for radiating a first and a second airwave signal in response to a first and a second conducted signal, respectively, said first airwave signal having a first frequency and said second airwave signal having a second frequency lower than said first frequency, comprising:

an electrically conductive base member;

a mast projecting upwardly from the base member to a masthead for forming a dipole for radiating said second airwave signal, the mast including an electrically conductive rod dielectrically coupled to the mast;

radiating means coupled said masthead for radiating said first airwave signal; and feeding means for feeding said first and said second conducted signal between the base member and said rod including a tuning sleeve electrically connected to the base member, coaxially disposed about the mast, and projecting upwardly from the base member for an electrical length of approximately ¼ wavelength at said first frequency; a lower mast extension extending from the mast and projecting downwardly from the base member to a foot for an electrical length of approximately ¼ wavelength at said first frequency; a lower rod extension coaxially disposed within the lower mast extension and electrically connected to the lower mast extension at said foot; and a coaxial cable to feed said first conducted signal and said second conducted signal, having an outer conductor electrically connected to the base member adjacent to the mast and having an inner conductor electrically connected to said rod adjacent to the base member.

2. A dual frequency vertical antenna for radiating a first and a second airwave signal in response to a first and a second conducted signal, respectively, said first airwave signal having a first frequency and said second airwave signal having a second frequency lower than said first frequency, comprising:

an electrically conductive base member;

a mast projecting upwardly from the base member to a masthead for forming a dipole for radiating said second airwave signal, the mast including an electrically conductive rod dielectrically coupled to the mast;

radiating means coupled to said masthead for radiating said first airwave signal; and feeding means for feeding said first and said second conducted signal between the base member and said rod including a tuning sleeve electrically connected to the base member, coaxially disposed about the mast, and projecting downwardly from the base member for an electrical length of approximately ¼ wavelength at said first frequency; a lower mast extension extending from the mast and projecting downwardly from the base member to a foot for an electrical length of approximately ¼ wavelength at said first frequency; a lower rod extension coaxially disposed within the lower mast extension and electrically connected to the lower mast extension at said foot; and a coaxial cable to feed said first and said second conducted signal, having an outer conductor electrically connected to the base member adjacent to the mast and having an inner conductor electrically connected to said rod adjacent to the base member.

* * * * *